US005285843A

United States Patent [19]

Dierbeck

[11] Patent Number: 5,285,843

[45] Date of Patent: Feb. 15, 1994

[54] MOUNTING ASSEMBLY FOR MODULAR HEAT EXCHANGER

[76] Inventor: Robert F. Dierbeck, 2707 Hall Rd., Hartford, Wis. 53027

[21] Appl. No.: 986,988

[22] Filed: Dec. 8, 1992

[51] Int. Cl.[5] ..... F28F 9/26; F28F 7/00

[52] U.S. Cl. ..... 165/69; 165/78; 165/83

[58] Field of Search ..... 165/69, 71, 78, 82, 165/83

[56] References Cited

U.S. PATENT DOCUMENTS

| | | | |
|---|---|---|---|
| 3,121,467 | 2/1964 | Bryant | 165/69 X |
| 3,858,291 | 1/1975 | Perpall | 165/69 X |
| 4,191,244 | 3/1980 | Keske | 165/69 |
| 4,295,521 | 10/1981 | Sommars | 165/69 |
| 4,763,724 | 8/1988 | Temmesfeld et al. | 165/71 |
| 4,979,560 | 12/1990 | Dierbeck | 165/76 |
| 4,981,170 | 1/1991 | Dierbeck | 165/109.1 |
| 5,042,572 | 8/1991 | Dierbeck | 165/76 |
| 5,137,080 | 8/1992 | Hoasch et al. | 165/78 |

*Primary Examiner*—Allen J. Flanigan

*Attorney, Agent, or Firm*—Andrus, Sceales, Starke & Sawall

[57] ABSTRACT

A demountable connector assembly for a modular heat exchanger permits individual modules to be removed and replaced without replacement of the entire heat exchanger core. As applied to heat exchanger modules of conventional tube and header construction, an end chamber on each end of the module has a thin flexible wall which allows axial extension of the module when it is installed between parallel inlet and outlet header surfaces to obviate the imposition of damaging stresses on the soldered connection joints between the heat exchanger tubes and the header plates. Stabilizing rubber cushions are placed between the flexible end walls of the module and its adjacent mounting bracket to prevent excessive modular movement and to dampen vibrations.

11 Claims, 2 Drawing Sheets

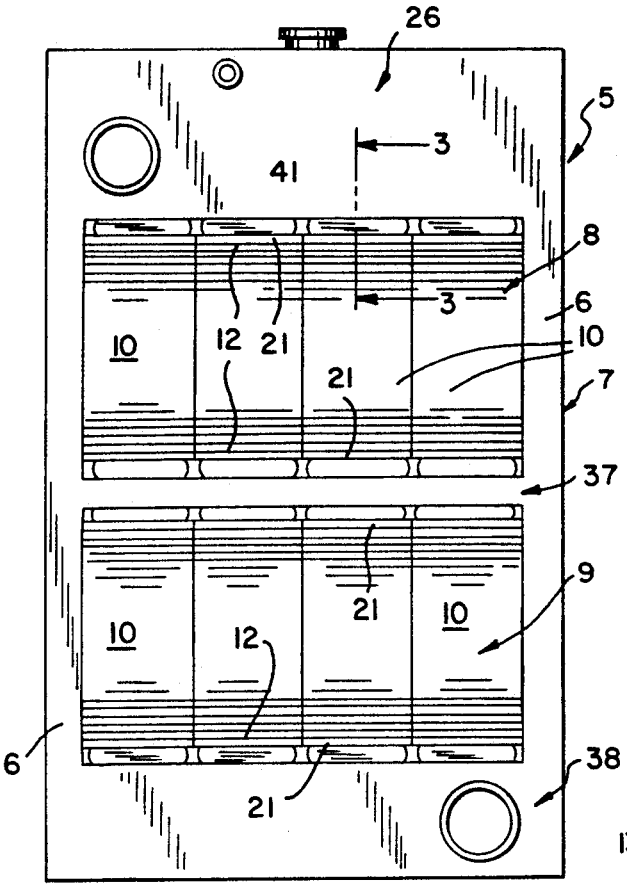
FIG. 1
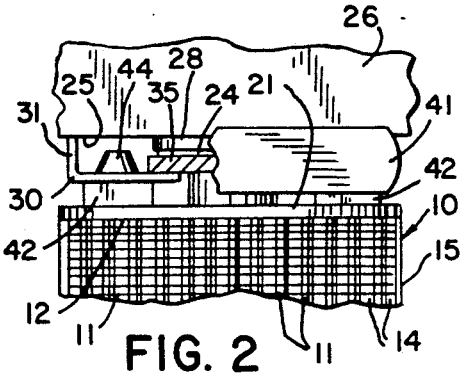
FIG. 2
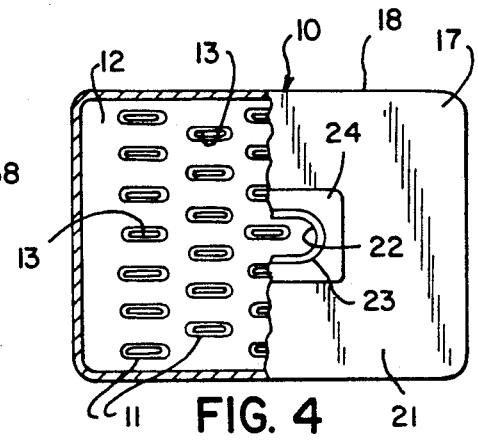
FIG. 4
FIG. 3
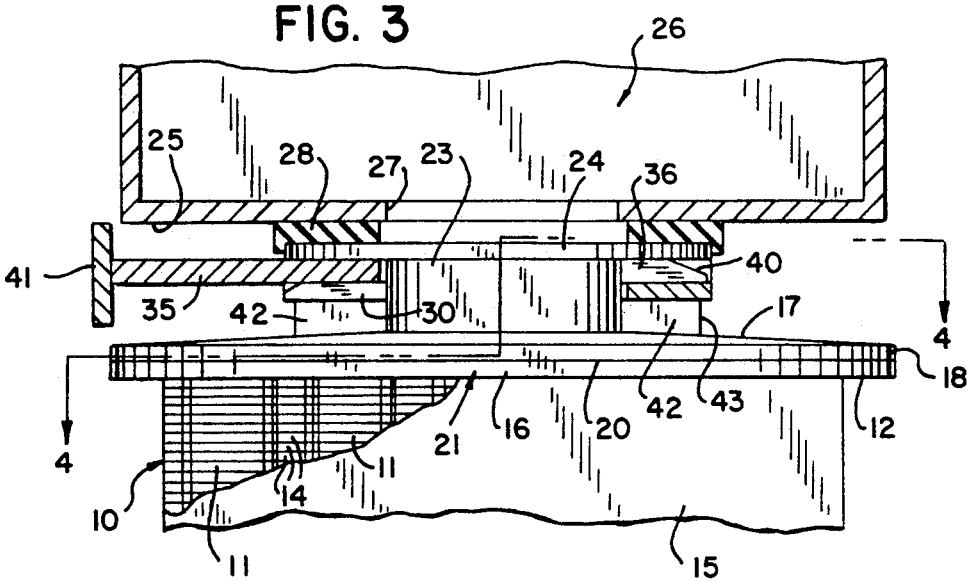

MOUNTING ASSEMBLY FOR MODULAR HEAT EXCHANGER

BACKGROUND OF THE INVENTION

The present invention pertains to a mounting assembly for a heat exchanger utilizing modular units and, more particularly, to a mounting assembly for axially flexible heat exchanger modules which is effective to stabilize the modules against vibration and excessive movement.

U.S. Pat. Nos. 4,979,560, 4,981,170 and 5,042,572 disclose various heat exchanger constructions, all of which are adapted to be made in a modular form in a manner in which they are separately and easily demountable from an array of such modules for replacement. A heat exchanger unit utilizing an array of such modules is particularly attractive for use as a radiator in the cooling system of a large vehicle, such as a truck or an off-the-road construction vehicle. Such vehicles are not only more susceptible to cooling system damage because of the environments in which they operate, but vehicle downtime is usually extremely critical and costly. The above identified patents describe modular heat exchange units which, if damaged in use, can be initially shunted out of the cooling system until a replacement module is available without taking the vehicle out of operation. A damaged module is easily removable and the replacement module may be as easily installed in a simple, fast and cost effective manner.

Although the heat exchanger modules of the prior art and their specific mounting assemblies operate quite satisfactorily, it has been found that, in the rather severe environment of heavy duty construction vehicles, the vehicle cooling systems, including the radiators using modular heat exchange units of the types described hereinabove, are subject to severe vibration and structural loadings resulting from loads on vehicle auxiliary equipment or the rough terrain over which these vehicles typically operate. As a result, severe vibrations and structural loadings are transferred to the soldered and/or brazed joints of the heat exchanger modules and may result in premature joint failure. Although portions of the heat exchange modules described in the foregoing patents are made purposely flexible to allow axial elongation under the stresses of mounting and thermal expansion, it would be desirable to provide a means of limiting such movement to prevent fatigue or direct structural failure from external vibration or structural shock loads.

SUMMARY OF THE INVENTION

In accordance with the present invention, a rubber vibration damper and shock load absorber is positioned between the axially flexible portion of each heat exchanger module and the mounting bracket by which the module is attached to a common cooling fluid header. The rubber cushioning means dampens the transmission of vibrations from the heat exchanger frame to the module and prevents excessive deflection of the module under severe external structural loads imposed on the frame, while allowing the necessary axial movement of the module to accommodate mounting and thermal expansion.

The improved mounting assembly of the present invention may be applied to any of the replaceable heat exchanger modules described in the above identified patents, which modules provide generally axial throughflow of a heat exchanging fluid between opposite inlet and outlet openings, which openings are defined by inlet and outlet flanges disposed on opposite ends of the module and in fluid communication with corresponding openings in the inlet and outlet headers between which the modules extend. Each header includes a mounting bracket which defines a slot for receipt of one of the module flanges for attaching the module to the header. Each module includes an end chamber which interconnects one end of the module to one or the other of the inlet and outlet flanges. Preferably, an end chamber is attached to both ends of the module for attachment to both the inlet and outlet flanges. The end chamber includes an enclosing end wall which is flexible in the axial direction of fluid flow through the module to accommodate axial elongation thereof, as by thermal expansion or the like. Flexible cushioning means are disposed between each mounting bracket and the adjacent flexible end chamber wall to stabilize the module against excessive movement and to damp vibrations transmitted thereto, without inhibiting the necessary axial expansion of the module.

The flexible rubber cushions are preferably disposed on opposite sides of each chamber opening to its respective header and the cushions are also preferably attached to the mounting brackets. The rubber cushions may include a plurality of tapered mounting buttons formed integrally therewith and adapted to be deformably pressed into and pass through a plurality of mounting holes in each of the mounting brackets to secure the cushions in place. The cushions are preferably made of a suitable synthetic rubber having a durometer of about 50 and may be selected from such synthetic rubbers as ABS and silicone rubber.

BRIEF DESCRIPTION OF THE DRAWINGS

FIG. 1 is a front elevation of a modular heat exchanger of the type used in a vehicle cooling system and utilizing the modular mounting assembly of the present invention.

FIG. 2 is a front elevation, partially in section, of a portion of a modular heat exchanger of the types shown in FIG. 1, utilizing tube and header construction and a mounting assembly of the present invention.

FIG. 3 is an enlarged sectional view taken on line 3—3 of FIG. 1.

FIG. 4 is a sectional view taken on line 4—4 of FIG. 3.

DETAILED DESCRIPTION OF THE PREFERRED EMBODIMENT

Figure 5:
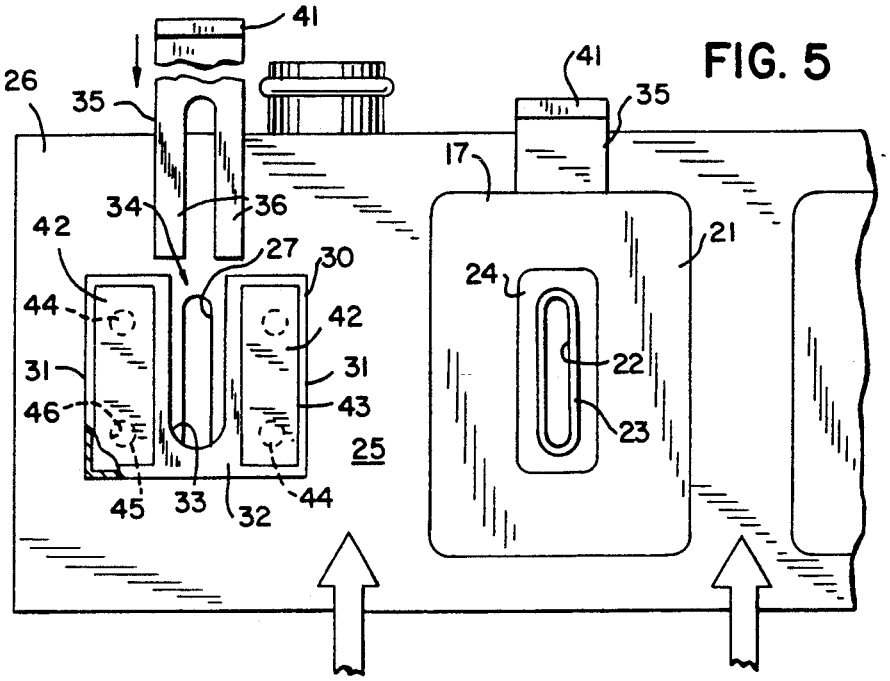
FIG. 5 is a bottom plan view of the common inlet header tank of FIG. 1 showing details of the mounting assembly of the present invention.

Referring to FIG. 1, a modular heat exchanger 5 includes an upper inlet header 26, intermediate header 37 and lower outlet header 38 all tied together by a pair of side frame members 6 to form a generally rectangular supporting frame 7. In the heat exchanger construction shown, upper and lower parallel arrays 8 and 9 of heat exchanger modules 10 are disposed in two tiers separated by the intermediate header 37. Each of the headers 26, 37 and 38 has a substantially open interior for the fluid flowing into or out of the modules 10. If an individual module 10 is damaged so that fluid is escaping from the system, that module is simply replaced by utilizing the mounting assembly and procedure to be described and a replacement module 10 attached in its place.

Referring to also FIGS. 2-5, the mounting assembly of the present invention is shown with heat exchanger modules 10 utilizing conventional tube and header construction. Each module 10 includes a series of tubular conduits 11 which extend in a generally parallel orientation between a pair of end plates 12. Each end plate is provided with a pattern of holes 13, each of which holes is adapted to receive one end of a tubular conduit 11 which is rigidly secured therein with a soldered or brazed connection, all in a well known manner. A multiplicity of fairly densely packed heat exchanging fins 14 are attached to the tubular conduits between the end plates 12, also in a known manner. The tube and fin assembly may be supported on opposite faces by a pair of side plates 15, but the module 10 is open in a direction parallel to the side plates to allow cooling air to flow readily over the tubes and fins generally in the direction of the arrows in FIG. 5.

Each end plate 12 has its peripheral edge upturned in a direction away from the module to form a peripheral lip 16. The end plates are relatively stiff and such stiffness is substantially enhanced by the rigid soldered connections of the multiple tubular conduits 11. A thin flexible end wall 17 is attached by its outer peripheral edge to the peripheral lip 16 of the end plate 12. Each end wall 17 may include a peripheral outer flange 18 for direct attachment to the lip 16 of the end plate, as with a soldered, brazed or welded seam 20. The connected end plate 12 and end wall 17 form chambers 21 on each end of the module 10.

The end wall 17 is provided with a central opening 22 which is defined by an axially extending sleeve 23. The opposite end of the sleeve 23 has attached thereto a mounting flange 24. The mounting flange 24 is adapted to overlie the bottom surface 25 of the inlet header 26 such that the central opening 22 to the chamber 21 is aligned with the outlet opening 27 from the header. A continuous compressible sealing member 28 overlies the outer face of the mounting flange 24.

The inlet header 26 is provided with a series of outlet openings 27 and a mounting bracket 30 is attached to the bottom surface 25 of the header at each fluid opening. Each of the mounting brackets 30 has a generally channel shape when viewed in FIG. 2 and includes a pair of parallel side flanges 31 secured to the header surface and an integral center plate 32 extending between the side flanges 31. The center plate 32 is provided with a U-shaped notch 33 large enough to allow the sleeve 23 on the end wall 17 to extend therein. The interior of the mounting bracket 30 and the bottom surface 25 of the header define a mounting slot 34 into which the mounting flange 24 and sealing member 28 may be slid as the sleeve 23 is received in the U-shaped notch 33. It is to be understood that the opposite end of each module 10 (which is attached either to an intermediate header 37 or an outlet header 38 as will be described in greater detail) is provided with an identical mounting assembly such that the mounting flange/sealing member subassemblies on each end of the module are simultaneously inserted into the mounting slots 34 in the mounting brackets 30.

A wedge 35 is then slidably inserted into the mounting slot between the inside surface of the center plate 32 and the surface of the mounting flange 24 opposite the sealing member 28 to compress the sealing member against the header surface 25 and secure the module thereto. The wedge 35 is bifurcated to define a pair of legs 36 which straddle the sleeve 23 as the wedge is inserted into the mounting slot 34. The remote edges of the legs 36 are provided with tapered ends 40 to facilitate initial insertion of the legs between the mounting brackets 30 and the mounting flange 24. The wedge may also be provided with a flanged handle 41 to facilitate manual insertion and removal of the wedge.

In a typical installation, the mounting flanges 24 and sealing members 28 on opposite ends of the module 10 are slid into their respective mounting brackets 30. One of the wedges 35 is then inserted, as indicated, to secure that end of the module to the header, while simultaneously compressing the sealing member 28 to provide a fluid-tight seal. As the wedge 35 on the other end of the module is inserted between the mounting bracket and the mounting flange, the sealing member 28 will begin to be compressed, but the wedging action will also cause an axial elongation of the module. Such axial elongation will be readily accommodated by the flexible end walls 17 so that no undue tensile load is imposed upon the relatively low strength joints between the tubular conduits 11 and the end plates 12.

The inherent flexibility of the end walls 17 forming one wall of the chambers 21 on each end of the module will also accommodate substantial axial movement of the module as a result of thermal stresses, blows to the heat exchanger frame, or a twisting thereof resulting from movement of the vehicle frame to which the heat exchanger may be attached.

To prevent excessive movement of the module 10 as from external structural loads which may twist the exchanger frame or vibrations transmitted from vehicle movement or the operation of auxiliary equipment, flexible rubber cushions 42 are placed between the mounting bracket 30 and the flexible end wall 17 of each module 10. A pair of cushions 42 is preferably placed one on each side of the sleeve 23 extending from the opening 22 in the chamber 21. Each cushion has a generally rectangular body 43 and a pair of integral frustoconical mounting buttons 44 extending from one side of the body. The mounting buttons 44 preferably include narrow neck portions 45 by which the buttons are joined to the cushion body 43. The center plate portion 32 of the mounting bracket 30 is provided on both sides of the U-shaped notch 33 with a pair of mounting holes 46 for the cushions 42. One pair of mounting holes 46 on each side of the bracket notch 33 is adapted to receive the pair of mounting buttons 44 of one cushion. The smaller end diameter of the frustoconical button 44 is preferably just slightly smaller than a mounting hole 46 to provide a lead-in for deformable insertion of the button through the mounting hole. The neck portion 45 is also slightly smaller in diameter than the mounting holes 46 such that, after the buttons are forced through the mounting holes, the cushions 42 are held snugly in place against the outside face of the mounting bracket 30. The cushion body 43 is sufficiently thin to allow initial unobstructed insertion of the module 10 into the mounting bracket, as previously described, without undue frictional contact between the flexible end walls 17 and the cushions. Subsequent insertion of the mounting wedge 35 draws the end wall 17 snugly against the face of the cushion body 43 such that, when the module is completely installed, the cushions 42 are captured snugly but without substantial compression between the mounting bracket and the end wall 17.

The rubber material from which the cushions are made is preferably a synthetic rubber such as ABS or silicone rubber having a durometer of about 50. The flexibility of the synthetic rubber cushions allows the module to expand adequately, as for example from thermal expansion, but stabilizes the movement against excessive movement and cushions the module against vibration. For example, after installation, a typical heat exchange module 10 might undergo an axial elongation of an additional 0.020 inch (0.5 mm) as a result of heating. The cushions will readily compress to accommodate such movement.

Figure 6:
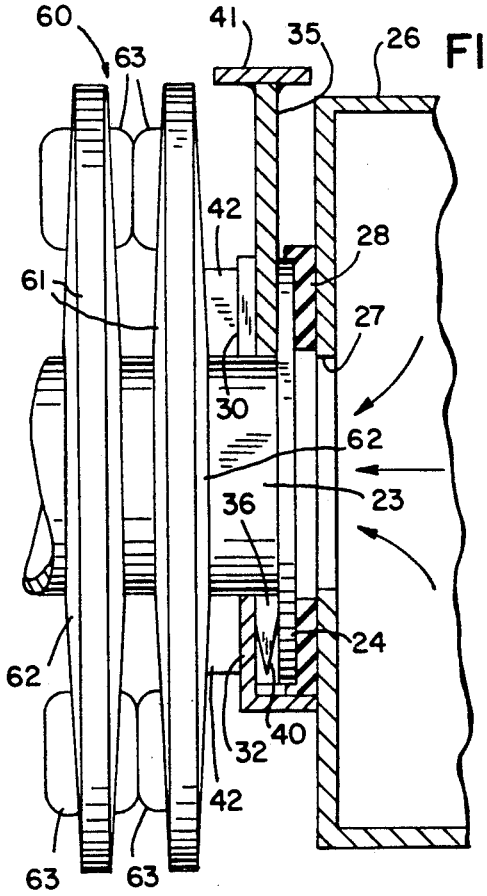
FIG. 6 is a partial sectional view of the mounting assembly of the present invention as applied to a heat exchanger module of alternate construction.

The cushioned mounting assembly of the present invention may also be utilized with an alternate construction of a heat exchanger module of the type shown in FIG. 6. This module 60, which is described in more detail in the above identified patents, includes a series of hollow interconnected corrugations 61 each of which includes an interior baffle plate to divert the generally axial flow of coolant in radial directions to provide greater heat exchanging surface contact as the fluid passes through the module. The corrugations each comprise flexible thin-walled chambers which may be formed, for example, from thin sheet metal stampings or even a high temperature-resistant plastic material. The thin walls 62 of the corrugations are adapted to flex to provide axial elongation or compression of the module 60 to accommodate thermal expansion or the axial movement caused during the module mounting process. Thus, the modules 60 are basically subject to the same types of movement as the modules 10 of the previously described embodiment, and are also subject to similar excessive externally imposed loads and vibrations.

The mounting assembly of the FIG. 6 embodiment utilizes the same rubber cushions 42 as previously described above to prevent excess movement and to damp vibrations between the end most corrugation 61 and the mounting bracket 30. However, similar excess movement between the corrugations 61 themselves must also be limited. Such limitation is provided by forming integral upstanding protrusions or ribs 63 in the end walls 62 of the corrugations and positioning the ribs 63 so that similar ribs in opposed walls 62 of adjacent corrugations 61 lie in abutting contact. The abutting ribs 63 do not interfere with the relatively small amount of axial movement between corrugations in normal operation, but prevent excessive movement as a result of severe externally applied loadings. The mounting assembly of the FIG. 6 embodiment is in all other respects identical to that shown in FIGS. 2-5.

Figure 7:
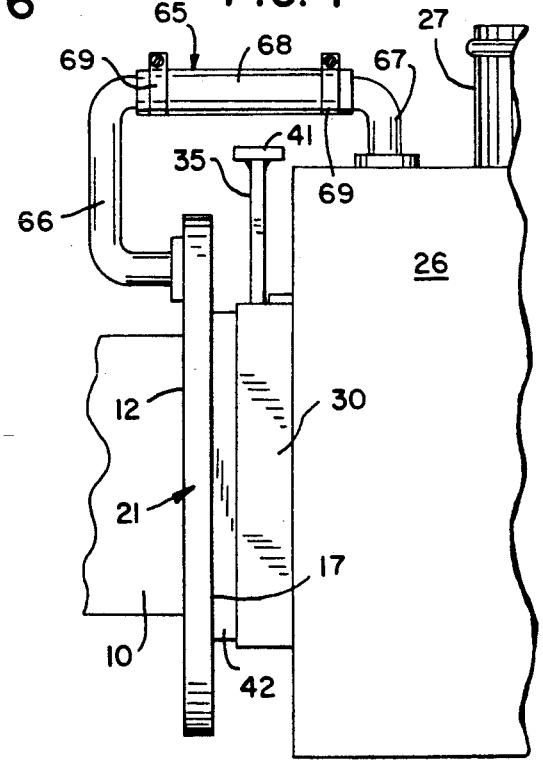
FIG. 7 is a generally schematic top view of a module mounted in a horizontal orientation and utilizing an alternate construction.

A heat exchanger utilizing modules of either of the embodiments described herein may in certain applications be mounted with the modules disposed horizontally. Such an installation is shown in a generally schematic view in FIG. 7. The heat exchanger module 10 is of the type shown in FIGS. 2-5 and includes an end chamber 21 formed by the interconnected end plate 12 and flexible end wall 17.

When a cooling system utilizing horizontally disposed modules is initially charged with a liquid coolant, pumped for example into the inlet header 26 via the header inlet 27, the flow of coolant into the module 10 make cause air to accumulate and form an air pocket in the upper end of the flexible end chamber 21. To allow this air to bleed off and to be replaced by the liquid coolant, an air bleed line 65 interconnects the upper end of the chamber 21 and the upper end of the inlet header 36. The bleeder line includes an air outlet line 66 from the chamber 21 and an air inlet line 67 to the header, both of which may comprise rigid connections of brass or another suitable metal. The ends of the outlet and inlet lines 66 and 67 are interconnected by a flexible rubber hose 68 attached with suitable hose clamps 69. In a multi-module heat exchanger, each module 10 is independently connected to the inlet header tank 36 with an air bleed line 65.

Various modes of carrying out the present invention are contemplated as being within the scope of the following claims particularly pointing out and distinctly claiming the subject matter which is regarded as the invention.

I claim:

1. In combination, a replaceable heat exchanger module of the type providing generally axial through-flow of a heat exchanging fluid between opposite inlet and outlet openings defined by respective inlet and outlet flanges disposable in fluid communication with corresponding openings in inlet and outlet headers and having end chambers interconnecting the module to the inlet and outlet flanges, the end chambers including an enclosing wall which is flexible in the axial direction of flow to accommodate axial elongation of the module;

a mounting bracket assembly associated with each flange having a slot receiving the flange and attachable to a header wall so as to sealingly mount the module thereto; and flexible cushioning means disposed between each mounting bracket and the enclosing wall of the associated end chamber for stabilizing the module against excessive movement and for damping vibration thereof.

2. The invention as set forth in claim 1 wherein said cushioning means comprises a pair of rubber cushions positioned on opposite sides of the fluid opening in the end chamber.

3. The invention as set forth in claim 2 wherein said rubber cushions are attached to the mounting bracket.

4. The invention as set forth in claim 1 including an end chamber connecting each end of the module to its respective opening flange.

5. The invention as set forth in claim 1 including an air bleed line interconnecting the end chamber and the inlet header.

6. An improved mounting assembly for a modular heat exchanger comprising:

a generally rectangular supporting frame;

an inlet header and an outlet header on opposite sides of the frame;

the headers having opposed spaced parallel surfaces, each surface having a series of fluid openings defining opposed pairs of fluid openings in said surfaces;

a heat exchanger module interconnecting each opposed pair of fluid openings to provide a parallel array of modules within the frame;

each module including fluid conducting and heat exchanging conduit means extending axially between and attached at opposite ends to a pair of end plates, a flexible end wall secured along its outer edge to the outer edge of each end plate to form therewith an axially expansible end chamber, each end wall having a centrally attached flange defining a chamber opening corresponding to one of said pair of fluid openings, and a compressible seal positioned between each flange and the header surface surrounding one of said fluid openings;

mounting bracket means attached to each of the headers in alignment with the series of fluid openings in the header surface, said bracket means defining with the header surface a series of mounting slots for receipt of the flange and seal on the common ends of the modules;

a pressure wedge slidably insertable into each slot between the bracket means and the flange to compress the seal and attach the module end to the header; and, flexible cushioning means disposed between each mounting bracket and the adjacent chamber end wall for stabilizing the module against movement.

7. The invention as set forth in claim 6 wherein said flexible cushioning means comprises rubber cushions disposed on opposite sides of each chamber opening.

8. The invention as set forth in claim 7 wherein said cushions are attached to the mounting brackets.

9. The invention as set forth in claim 8 including a plurality of mounting holes in each mounting bracket and a plurality of tapered buttons formed integrally with said cushions, said buttons adapted to be deformably pressed into and to pass through said mounting holes to secure the cushions in the attached position.

10. The invention as set forth in claim 9 wherein said cushions are made from a synthetic rubber material having a durometer of about 50.

11. The invention as set forth in claim 10 wherein the synthetic rubber material is selected from the group comprising acrylonitrile-butadiene-styrene and silicone rubber.

* * * * *